US008403253B1

(12) United States Patent
Cohen et al.

(10) Patent No.: US 8,403,253 B1
(45) Date of Patent: Mar. 26, 2013

(54) ACTIVE IR SIGNATURE TARGET SIMULATION SYSTEM AND A METHOD THEREOF

(75) Inventors: Shimon Cohen, Chashmonaim D.N. (IL); Edi Maor, Rishon LeZion (IL)

(73) Assignee: Israel Aerospace Industries Ltd., Lod (IL)

( * ) Notice: Subject to any disclaimer, the term of this patent is extended or adjusted under 35 U.S.C. 154(b) by 849 days.

(21) Appl. No.: 12/406,485

(22) Filed: Mar. 18, 2009

(51) Int. Cl.
*B64D 47/00* (2006.01)
*F42B 12/00* (2006.01)
*F41G 3/26* (2006.01)

(52) U.S. Cl. ..... 244/1 R; 244/171.8; 244/121; 89/1.11; 102/513; 434/21

(58) Field of Classification Search ..... 244/1 R, 244/117 A, 121, 134 B, 134 D, 171.8; 89/36.01, 89/36.08, 36.11, 36.12, 938, 1.11; 102/335, 102/336, 347, 513; 342/1–4; 434/19, 21
See application file for complete search history.

(56) References Cited

U.S. PATENT DOCUMENTS

| | | | | |
|---|---|---|---|---|
| 3,765,354 | A * | 10/1973 | Gronroos | 114/312 |
| 4,801,113 | A | 1/1989 | Engelhardt | |
| 4,923,146 | A * | 5/1990 | Anthony | 244/117 A |
| 5,336,894 | A | 8/1994 | Ellers | |
| 5,427,032 | A * | 6/1995 | Hiltz et al. | 102/336 |
| 5,751,006 | A * | 5/1998 | Cooper | 250/495.1 |
| 5,971,323 | A * | 10/1999 | Rauch et al. | 244/134 D |
| 6,055,909 | A | 5/2000 | Sweeny | |
| 6,338,292 | B1 | 1/2002 | Reynolds et al. | |
| 6,393,989 | B1 | 5/2002 | Weimer | |
| 6,571,714 | B1 * | 6/2003 | Brum et al. | 102/336 |
| 6,612,523 | B2 * | 9/2003 | Gardner | 244/117 A |
| 6,720,907 | B1 | 4/2004 | Miron | |
| 6,756,932 | B1 * | 6/2004 | Barker et al. | 342/4 |
| 7,190,304 | B1 | 3/2007 | Carlson | |
| 7,753,315 | B2 * | 7/2010 | Troy | 244/171.3 |
| 2005/0230517 | A1 * | 10/2005 | Troy | 244/2 |
| 2006/0060691 | A1 * | 3/2006 | Burns | 244/1 TD |
| 2006/0249009 | A1 * | 11/2006 | Rubin | 89/1.11 |
| 2007/0026177 | A1 | 2/2007 | Kitahara et al. | |
| 2007/0028791 | A1 | 2/2007 | Bredy | |
| 2009/0277993 | A1 * | 11/2009 | Storch | 244/117 A |
| 2010/0000231 | A1 * | 1/2010 | Meir | 62/3.7 |

FOREIGN PATENT DOCUMENTS

| | | | |
|---|---|---|---|
| EP | 0 911 601 | A2 | 4/1999 |
| EP | 1 637 829 | A1 | 3/2006 |
| JP | A-06-109549 | | 4/1994 |
| WO | WO 2008/018072 | A2 | 2/2008 |
| WO | WO 2009/040823 | A2 | 4/2009 |

* cited by examiner

*Primary Examiner* — Joseph W Sanderson
(74) *Attorney, Agent, or Firm* — Oliff & Berridge PLC

(57) ABSTRACT

An active IR signature target simulation system which includes: a platform having a known temperature profile and a preplanned flight trajectory; a heat source carried onboard the platform, capable of producing heat following a controlled heating plan; and a control unit connected to the heat source and configured for initiating the heat source, thereby modifying the known temperature profile and generating a desired temperature profile required for sensing a simulated target IR signature during a simulation time window at a desired line of sight from the platform to an observing sensor, wherein the platform is an exo-atmospheric missile which includes an inner shell and a perforated outer shell, and wherein the heat source is a thermally active material disposed between at least a part of the inner shell and a part of the outer shell.

2 Claims, 5 Drawing Sheets

ACTIVE IR SIGNATURE TARGET SIMULATION SYSTEM AND A METHOD THEREOF

FIELD OF THE INVENTION

This invention relates to target simulation and more specifically to active IR (thermal) signature target simulation.

BACKGROUND OF THE INVENTION

Prior art references considered to be relevant as a background to the invention are listed below and their contents are incorporated herein by reference. Acknowledgement of the references herein is not to be inferred as meaning that these are in any way relevant to the patentability of the invention disclosed herein.

Thermal (IR—Infra Red) signature is used in many military as well as civilian applications for locating a target. U.S. Pat. Nos. 7,190,304 and 6,720,907 and Patent application Nos. 2007/026177 and 2007/0028791 illustrate several known approaches for using thermal signature.

Target simulation is needed for various tasks, such as operators' training, equipment design and testing (e.g. sensors, countermeasures, guidance systems, targeting systems), operational tasks (e.g. as a decoy), and many more. U.S. Pat. Nos. 6,055,909 and 6,393,989 and EP Patent Nos. 0911601 and 1637829 disclose several known approaches for simulating the thermal signature of a target.

As an example, in accordance with one known approach in the field of Long-Range Missiles (LRM), simulation of the thermal signature of a threat (e.g. enemy missile) is achieved by providing the simulation missile with substantially the same structure and trajectory as the threat (target). Thus, the thermal signature of the simulation missile is built in accordance with the aerodynamics properties of the simulation missile. Following this approach, dedicated simulation missiles need to be developed in order to simulate a specific target. This takes valuable time and resources.

There is a need in the art for an efficient, relatively inexpensive method and system for simulating the IR (Thermal) Signature of a moving or a stationary body in the sky (e.g. a missile or a decoy flying in space including in the exo-atmosphere and endo-atmosphere. There is a need in the art for a versatile system and a flexible method, suitable for simulation of different thermal signature profiles. There is a further need in the art for simulating the dynamics of a thermal signature on-demand in space and time, in a desired wavelength range.

SUMMARY OF THE INVENTION

Unless defined otherwise, all technical and scientific terms used herein have the same meaning as commonly understood by one of ordinary skill in the art to which this invention belongs. Generally (although not necessarily), the nomenclature used herein described below are well known and commonly employed in the art. The terms "thermal signature" and "IR signature", as used hereinafter, are used in their broader meanings, which encompass, among other definitions, the relative thermal radiation of an object with respect to a background, which makes the object visible to IR (Infra Red) photography. The term "missile" is used in its broader meaning, which encompasses any missile or rocket, irrespective of type, weight, shape, manner of launch and other characteristics. Other bodies in the sky, e.g. UAV or a decoy, are referred to as a "platform" or "missile".

According to an aspect of the invention there is provided an active IR signature target simulation system, comprising: a self-propelled or non-self propelled platform having a known temperature profile and a preplanned trajectory; heat source carried onboard the platform, capable of producing heat following a controlled heating plan; and a control unit coupled to the heat source and configured for initiating the heat source, thereby modifying the known temperature profile and generating a desired temperature profile required for sensing a simulated target IR signature during a simulation time window at a desired line of sight from the platform to an observing sensor.

According to an embodiment of the invention, the known temperature profile varies in time, e.g. depends upon aerodynamics properties of the platform, e.g. aerodynamics of a missile, a rocket, UAV (Unmanned Airborne Vehicle) or a decoy, each having a different temperature profile.

According to embodiments of the invention, the platform comprises one or more sub-systems, e.g. fuel subsystem, guidance subsystem, communication unit and more. According to an embodiment of the invention, the heat source is thermally and/structurally separated from at least one subsystem of the platform. This allows the platform to survive the initiation of the heat source, and to produce a longer simulation time window.

The present invention is suitable for simulation of various targets. According to a broad aspect of the invention, a moving or a stationary target is simulated, provided it has a target IR signature which is stronger (higher) than an IR signature corresponding to the platform's known temperature profile during at least the simulation time window. Specifically, a long-range missile could be simulated by a long-range missile, a short-range missile or a decoy-based simulation system.

According to another aspect of the invention there is provided a method for active IR signature simulation, comprising equipping a platform having a known temperature profile and a controlled trajectory with a heat source; and initiating the heat source in a controlled heating plan for producing heat as required for modifying the known temperature profile and generating a desired temperature profile, thereby allowing sensing a simulated target IR signature during a simulation time window at a desired line of sight from the platform to an observing sensor.

In order to allow an observing sensor to sense a desired (simulated) IR signature, a desired temperature profile is generated by adding heat in a controlled manner to a known temperature profile at a selected simulation window and a selected line of sight from the simulation system to the observing sensor. According to an embodiment of the invention, wherein the known temperature profile includes a low temperature zone along the trajectory of the platform (e.g. as a missile traveling in the endo-atmosphere), the heat is produced while the platform travels in the low temperature zone. According to another embodiment of the invention, wherein the known temperature profile varies along the trajectory of the platform (e.g. aerodynamically built), heat is provided in a respective manner in order to produce the desired temperature profile required for simulation.

According to an embodiment of the invention, the controlled trajectory and controlled heating plan are preplanned and carried out by the control unit in an autonomous manner. According to another embodiment, the controlled trajectory and controlled heating plan are carried out by the control unit under control of a remote unit. According to yet another embodiment of the invention, the controlled trajectory and controlled heating plan are affected by a remote unit on the fly, to produce one or more of the following with respect to an observing sensor: the desired temperature profile; the simulation time window; the desired line of sight; and the simulated IR signature.

BRIEF DESCRIPTION OF THE DRAWINGS

In order to understand the invention and to see how it may be carried out in practice, certain embodiments will now be described, by way of non-limiting example only, with reference to the accompanying drawings, in which.

DETAILED DESCRIPTION OF CERTAIN EMBODIMENTS OF THE INVENTION

The present invention is useful for the simulation of any IR radiating body. In the following, the present invention will be disclosed with respect to the simulation of the thermal signature of missiles, which travel in part of their trajectory in the exo-atmosphere and the endo-atmosphere. Such missiles are typically detected by sensors in certain wavelength ranges and acquired by countermeasures while leaving or entering the atmosphere. Typically, detection capabilities of a sensor are tested before the target re-enters the atmosphere, where the IR signature is near its lower range. In order to simulate a pre-defined IR Signature (e.g. signature of a specific threat), according to an embodiment of the invention, the thermal behavior of a missile external skin surface is actively simulated over its flight phases.

Figure 1A:
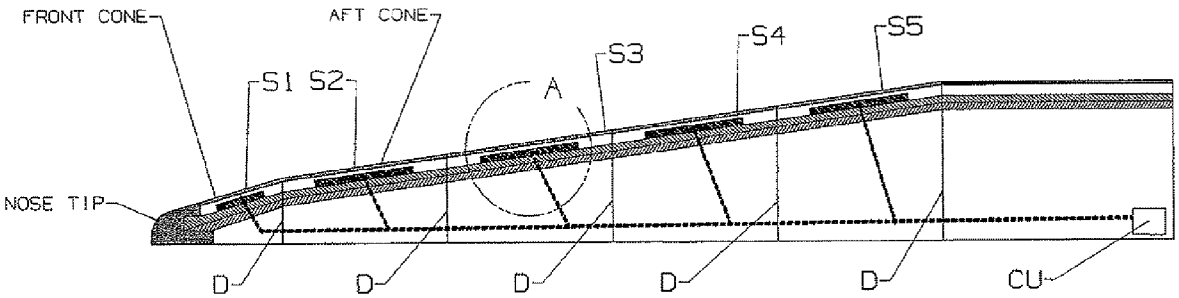
FIG. 1*a* is a partial cross-section of an IR signature simulation system according to an embodiment of the invention.
Figure 1B:
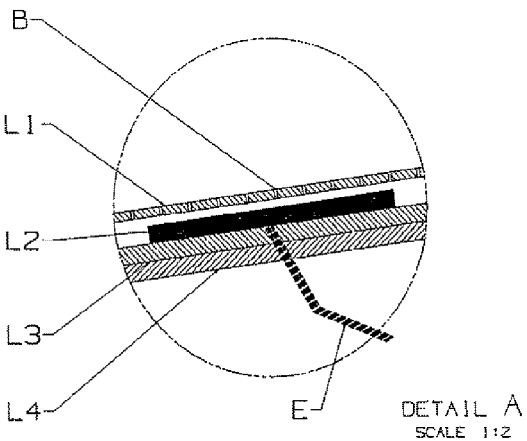
FIG. 1*b* is an enlarged view of a detail of FIG. 1*a;*

FIG. 1*a* is a partial cross-section of a missile system 10 according to an embodiment of the invention, installed along a generic missile KV (Kill Vehicle). FIG. 1*b* is an enlarged view of a detail of FIG. 1*a*. As illustrated in a non-limiting manner, the skin of a missile 10 comprises four layers: an outer layer L1 (outer shell of the missile), a thermally active layer L2, insulator layer L3, and an inner layer L4 (inner shell of the missile). According to an embodiment of the invention, the thermally active layer L2 is made of e.g. gasless thermite as asbestos bedding carrying pyroelectric material such as iron powder potassium perchlorate or zirconium barium chromate, which can generate energy for IR thermal simulation over a wide range of intensities on demand. The invention is not limited by the type of the active material, and other materials such as hydrazine (or other type of liquid fuel), NTO/MMH and other heat source means, could be used without departing from the scope of the present invention.

According to an embodiment of the invention, the outer layer L1 is made of steel, e.g. SAE 4130 steel, 2 mm thickness. According to an embodiment of the invention, the outer layer L1 is perforated, to expel residual gases, if present, and reduce weight overload. As a non-limiting example, the expelled gases are forced to flow through 1 mm bores spread over the outer skin, 10 centimeter apart. The insulation layer L3 is based on cork or ceramics, serving as an adiabatic wall. According to an embodiment of the invention, L4, the inner shell of the missile, is made of steel, e.g. SAE 4130 steel, 0.8 mm thickness. The above-detailed four-layer structure is provided for maintaining the inner structure of the missile at an allowable temperature.

According to a non-limiting example, the body of the missile system 10 is divided into sections. Five such sections S1-S5 are illustrated in FIG. 1*a* in a non-limiting manner. According to an embodiment of the invention, dividers D divide the missile's body into separated sections. According to another embodiment (not illustrated), the dividers of the layers provide thermal separation between sections of an unassigned missile, leaving the missile's body undivided. The amount of the active material in a specific section (e.g. the thickness of the active material) depends upon operational needs.

According to an embodiment of the invention, the active material in each section is coupled via electrical wiring E to a control unit CU. According to an embodiment of the invention, the control unit CU is configured to initiate the active material, located at different sections, autonomously, according to a pre-planned scheme (heating plan). According to another embodiment of the invention, the CU is capable of communicating with a remote control station (via communication means, not shown), and thus allows remote control of the operation of missile system 10 and external activation of the active material. Not shown in FIGS. 1*a*-1*b* are additional systems which may be mounted onboard the missile 10 such as additional logic, sensors, guidance system and more.

It should be understood that the invention is not limited by the illustrated structure and other structures could be used without departing from the scope of the invention, including, but not limited to, the following structures: non-perforated outer shell; partial cover of the inner shell by the outer shell; even or non-even distribution of the active material.

In operation, the pyroelectric material is electrically triggered to ignite, and generate heat for a certain period of time, thus increasing the temperature of the outer skin made of steel. In order to achieve a desired thermal signature, a desired level of temperature is required. The numbers of sections, the amount of the active material in each section, the placement of the active material onto the missile's body, the order and timing of activation have to be considered in order to produce the desired level of temperature of the external skin.

Typically, a target is simulated in order to be sensed by an optical sensor, e.g. a sensor in test, a sensor of a countermeasure in test, and the like. As known in the art, the specification of the sensor and particularities of observation, e.g. the acquisition distance and LOS (Line of sight) between the simulated target (simulation missile system 10) and the sensor, are considered.

The following non-limiting examples further illustrate the present invention:

First Example

Ground Test

A 3 mm layer of an active material was attached to a 2 mm steel plate. A sensor was placed above the plate. The initial temperature of the plate was 180° C., giving rise to an IR thermal signature intensity of 7 W/sr (Watt per Steradian). The active material was ignited and consequently the temperature of the steel plate increased, in about 60 seconds, up to 320° C. and then moderately cooled down. At maximum temperature, a corresponding value of 51 W/sr was measured by the sensor.

Second Example

Simulation System Based on an Operational Missile

According to one embodiment, the invention implements an operational missile by minimally modifying its existing systems. In this non-limiting example, the following elements are considered for simulation of a typical threat missile:

a cone of a length of 1 m and base diameter of 0.5 m;
a conical outer shell of 2 mm (13 Kg);
a layer of 6 mm insulation material (3 Kg);
a layer of 3.3 mm active material (2.8 Kg).

Thus, the additional weight required in order to modify an operational missile to a target simulator is about 19 Kg, e.g. about 5-10% of the missile's weight. The effects (e.g. dynamic effects) of the required additional weight could be mitigated by utilizing solutions known in the art. In order to prepare it as a target simulator, the missile's insulation shields are removed. The outer skin becomes the inner shell, and is covered by an active material as desired (where required) and an outer shell (e.g. perforated outer conical shell).

Third Example

Three-Layer Structure

To address various operational requirements, in accordance with an embodiment of the invention, a three-layer structure is provided, including a steel layer, e.g. a skin of a missile; an insolating layer at the inner side or the outer side of the steel layer; and a thermally active layer disposed onto the outer side of the steel layer.

Fourth Example

Two-Layer Structure

According to another embodiment, a two-layer structure is provided, for example, utilizing a relatively light-weighted body (e.g., a pressurized decoy) having a thermally active material disposed onto its outer face. This example will be discussed below with reference to FIG. 5.

In accordance with an embodiment of the invention, the simulated IR signature is generated at a specific time and place, for a specific duration (simulation time window) on a moving body with a specific directivity, in order to produce a desired IR signature intensity with respect to a specific LOS (Line of Sight) ("scenario"). This enables using a variety of moving bodies for simulation of desired targets. For example, various long-range or short-range missiles or rockets, including relatively cheap and non-sophisticated missiles or rockets, could be used for the simulation of a specific enemy threat. In accordance with an embodiment of the invention, different scenarios are addressed by allocating each scenario with a different simulation missile, appropriately designed, on-demand.

In the following, the simulation design principles of a required specific thermal signature, based on a complete thermal analysis, are presented:

The IR signature of a body is actually the radiant intensity, which is basically expressed by Planck's spectral distribution of an emissive power, as formulated in Equation 1. For simplicity, it is given here for a Lambertian surface e.g. a perfectly diffuse surface, which has a constant radiance independent of the viewing direction.

$$IRS[W/sr] = \sum_{i=1}^{N}\left(\frac{\varepsilon_i}{\pi}\int_{\lambda_1}^{\lambda_2}\frac{C_1 * \partial\lambda}{\lambda^5\left[\exp\left(\frac{C_2}{\lambda * T_i}\right)-1\right]}\right) * S_i \tag{1}$$

where:
$\lambda$ is the wavelength (μm)
$C_1$ and $C_2$ are Plank's constants:
C1=3.743*10$^{-8}$ (Wμ$^4$/m$^2$)
C2=1.4387*10$^4$ (μ*° K.)
$\epsilon$ stands for the surface emissivity;
S is the projected area in the direction of the LOS (m$^2$)
N is the number of sections
T is the surface temperature (° K.)

In order to compute the IR signature, the dynamics of wall heat flux development and heat losses have to be considered. This is given by Equation (2):

$$Q = \frac{(T_S - T_\infty)}{R} + C\frac{dT}{dt} \tag{2}$$

Where:
T is the instantaneous skin temperature (° K.)
Q is the heat flux, generated by the active material (W/m2)
$T_S$ is the instantaneous skin temperature (° K.)
$T_\infty$ is the ambient temperature (° K.)
R is the thermal resistance of the skin to ambient (° K./W/m2)
C is the heat capacity of the material (J/° K./m2) and
t is the time, (s).
T is the external skin temperature (° K.)

Equations (1) and (2) are used to define the required heat flux and hence the active material thickness, in order to produce a desired thermal signature. This is illustrated in FIG. 2, showing a non-limiting simulation of a behavior of the temperature of a missile's skin as a function of time during flight.

As presented in Equations (1) and (2), the following parameters are to be prescribed in order to determine the amount (thickness) of active material required for simulating a desired thermal signature: wavelength range (specific wavelength ranges are typically required); properties of the inner and outer shells (e.g. material type, thermo-physical properties); and chemical and physical properties of the active material.

Figure 2:
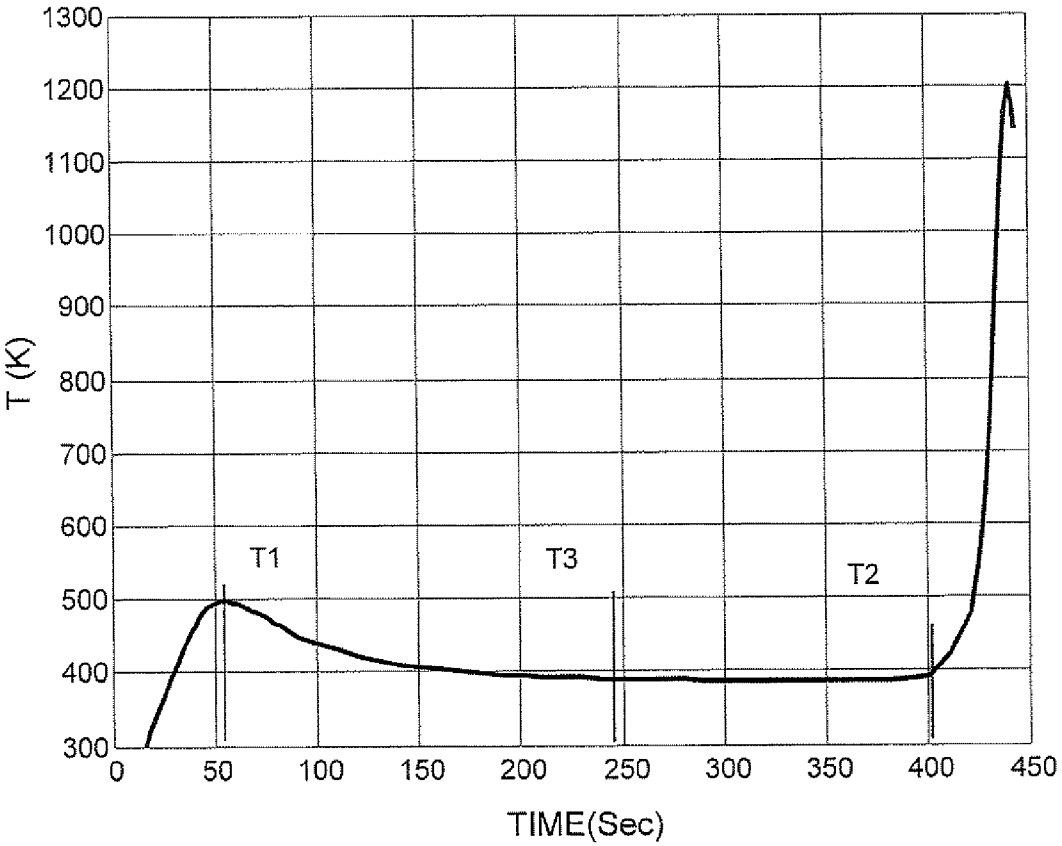
FIG. 2 is a schematic illustration of surface temperature variation with time along various phases of a generic missile flight.

As shown in FIG. 2, the temperature of the missile's skin starts to increase after launch and reaches its peak after the missile leaves the atmosphere ($T_1$). Outside the atmosphere the skin is cooled down and is reheated when the missile re-enters the atmosphere ($T_2$). Typically, a target is detected based on its thermal signature during leaving or entering the atmosphere. Thus, in order to be acquired as a target, the simulation missile system needs to simulate the temperature dynamics of the target for a pre-determined time window.

Figure 3:
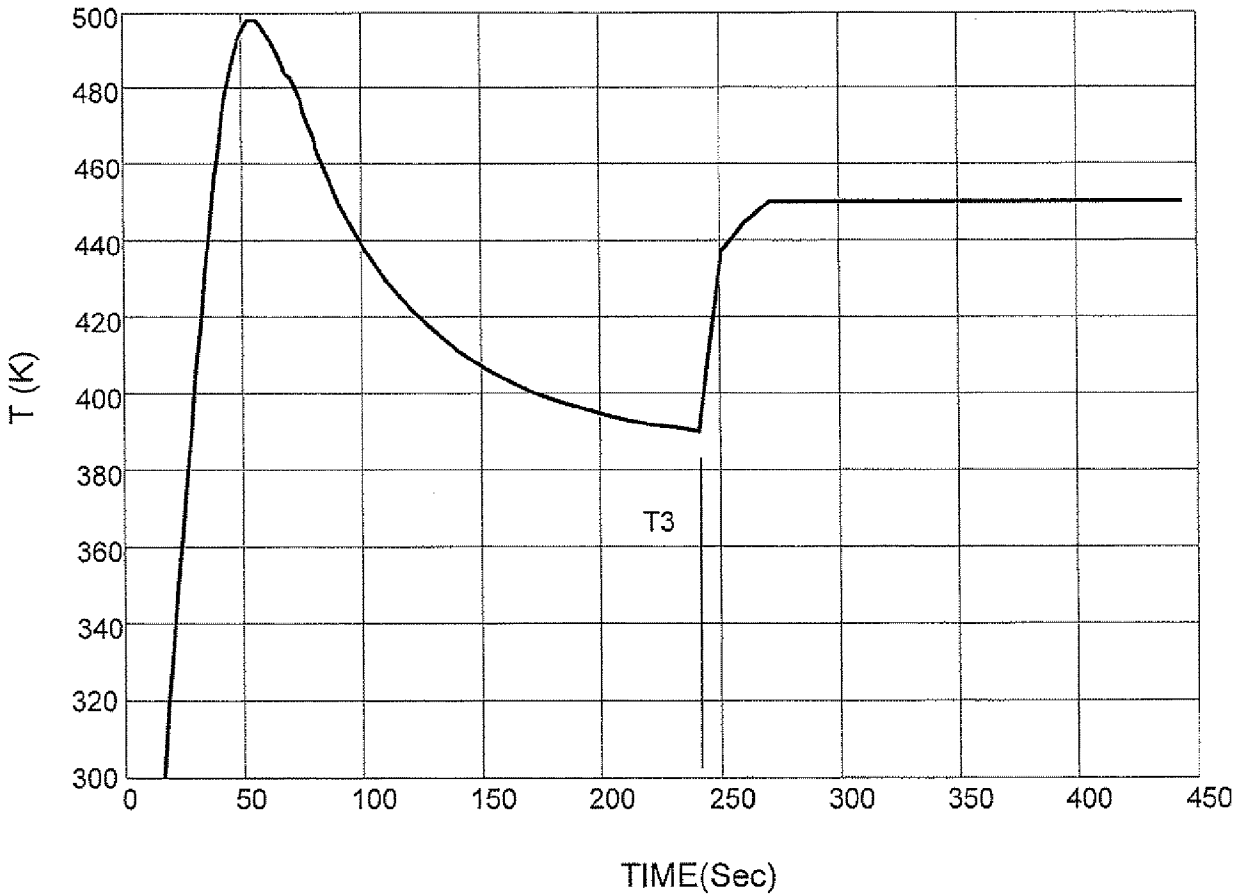
FIG. 3 is a schematic illustration of another surface temperature variation with time along various phases of a generic missile flight, in accordance with an embodiment of the invention.
Figure 4:
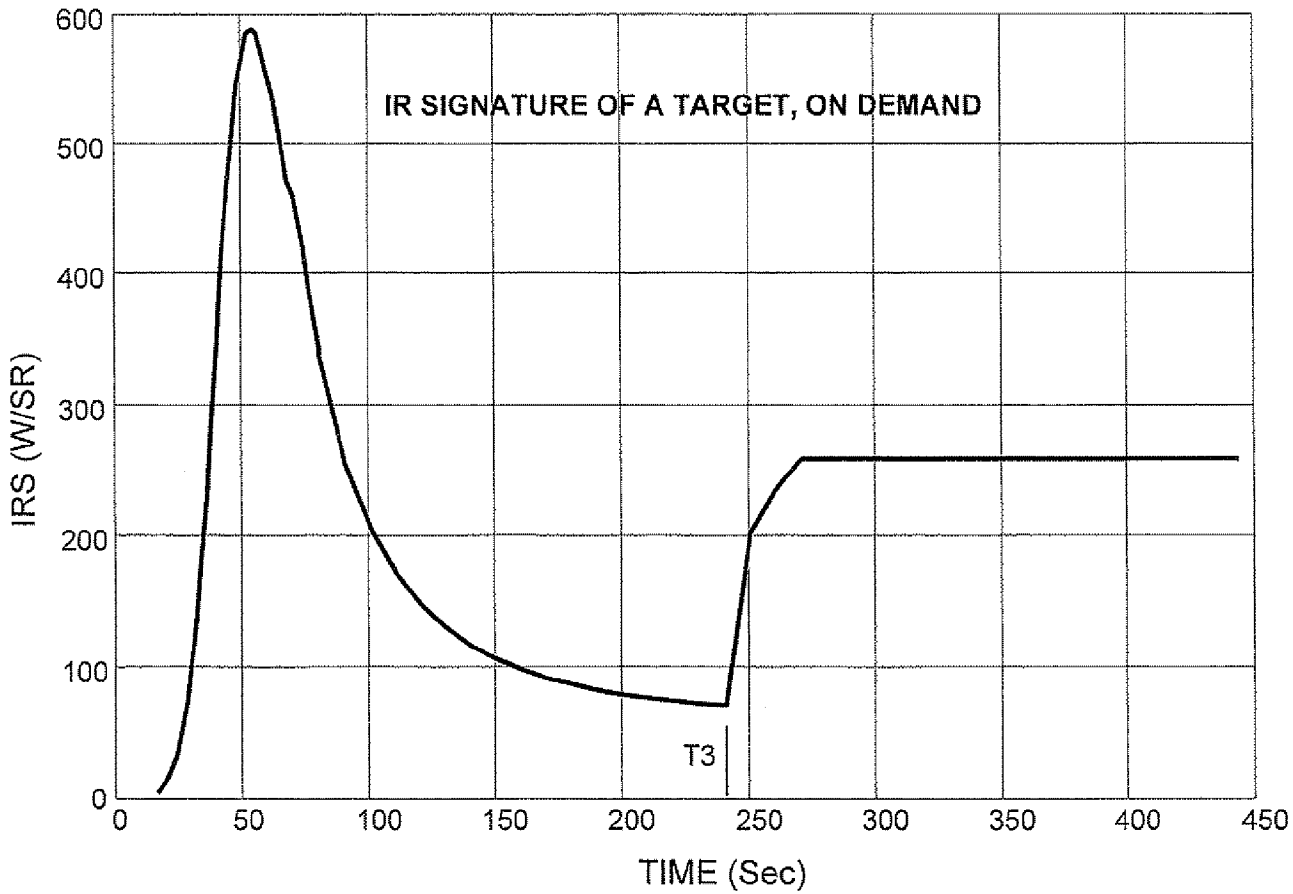
FIG. 4 corresponds to FIG. 3, and schematically illustrates an IR Signature in accordance with an embodiment of the invention.

In order to simulate the target, the flight of the simulation missile is pre-planned such that the simulation missile will appropriately appear on the sensor fpa (focal plane array) at phase $T_3$, while producing the required temperature. This is schematically illustrated in FIG. 3. The temperature of the skin of the simulation system follows the generic behavior illustrated in FIG. 2 (minimal temperature around $T_3$) thus, according to an embodiment of the invention, in order to simulate a specific target, the temperature of the simulation missile (e.g. missile system 10 illustrated in FIGS. 1*a*-1*b*) in $T_3$ is actively controlled, in a pre-determined manner, to simulate that of the target as before, during and after T2 (endo-atmosphere). The resultant IR signature corresponding to the temperature variation in time of the missile's external surface before and after initiating the active thermal signature system is depicted in FIG. 4.

Figure 5:
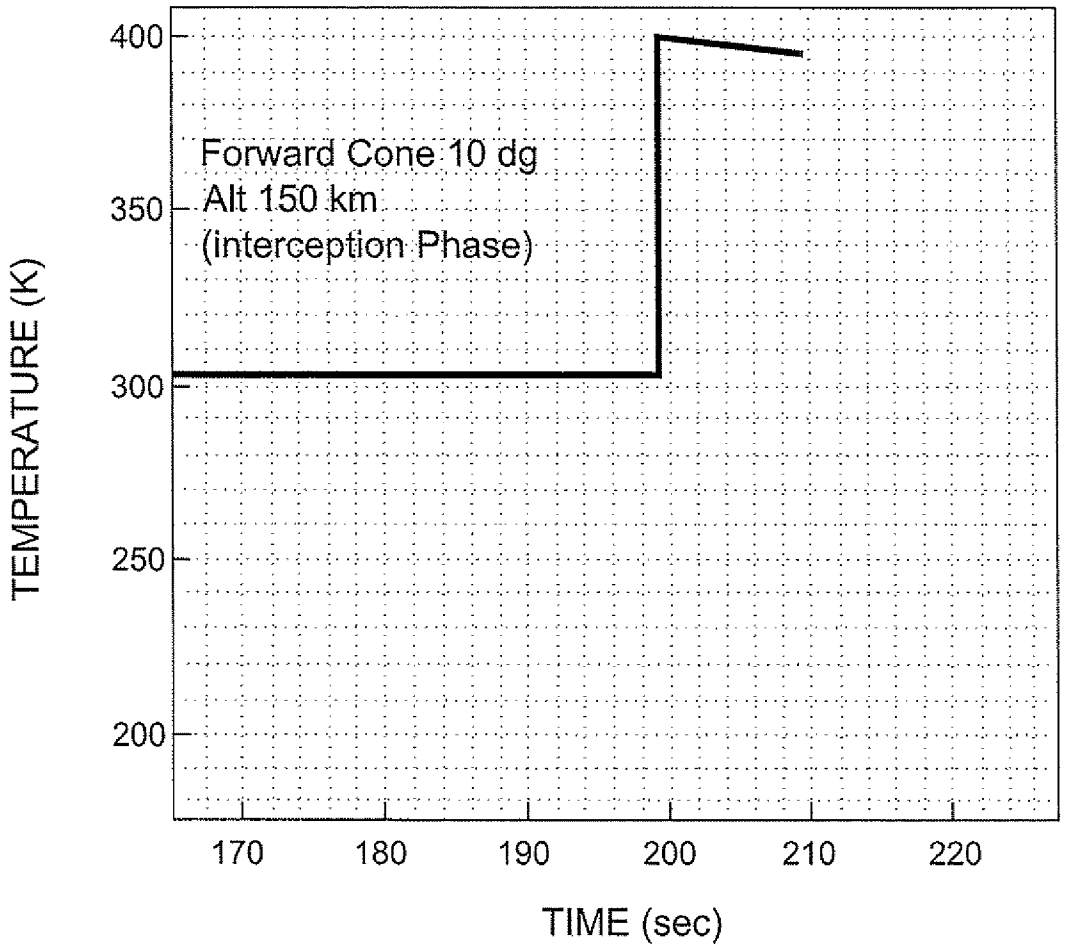
FIG. 5 is a schematic illustration of the skin surface temperature of a simulation system in accordance with an embodiment of the invention.

Turning back to the fourth example (discussed above with respect to FIG. 1): a pressurized decoy is used as the platform. According to an embodiment of the invention, a relatively light-weighted body (e.g. a few Kg) is used. The active material is disposed onto the top face or the bottom face, or both (two-layer structure). No protecting layers are required. Upon activation, heat is rapidly generated. A non limiting example of the generation of heat over time on a decoy is illustrated in FIG. 5: the use of a pressurized decoy made of a thin film is simulated. The film is covered—on its outer or inner face—with an active material intended to generate a surface temperature of 384° K. over 10 seconds beginning at 200 seconds after decoy launch. As depicted in FIG. 5 in a non limiting manner, the skin surface temperature has been maintained at a constant level over the required time window. The corresponding IR signature for a specific decoy depends on the aspect angle as well as the wavelength range of the optical sensor.

In order to produce the desired temperature change in a dynamic manner, various initiating schemes (heating plans) could be pre-planned. According to embodiments of the invention, at least the following parameters are considered in the design of a specific heating plan:

- type and amount of active material;
- number, size, and place of the sections;
- allocation of active material in each section: disposing it in an even or non even manner along the axial axis of the missile; disposing it in an even or non even manner on the periphery of the missile;
- type and thickness of the outer shell; and
- size, number, shape of the bores of the outer shell.

Thus, according to an embodiment of the invention, the simulation of a target by a simulation missile requires affecting the temperature of the missile's skin to produce a desired thermal signature, at a desired place and time, while the simulation missile is moving in a desired direction (desired LOS with respect to an acquisition system). It should be understood that the invention is not limited by the techniques that could be used for bringing the missile to a desired place at a desired time with a desired LOS, and many techniques known in the art for missile maneuvering could be used without departing from the scope of the present invention.

In accordance with an aspect of the invention, there is provided a method for operating a simulation missile system, comprise the following steps:

- bringing the missile carrying thermally active material on its outer skin in accordance with a required design, to a selected location in space at a selected time.
- initiating the thermally active material in accordance with a pre-planned scheme to generate a desired heat,
- thereby allowing simulating the target on a sensor fpa.

According to an embodiment of the invention, the IR signature of the platform prior to heat generation is not sensed by the sensor. This is achieved e.g. by properly selecting the simulation time window: timing the trajectory of the simulation target (placement in space) with its temperature profile. Upon heat generation, the sensor is able to acquire the simulation target.

Utilizing known techniques, processing of the sensed data enables, for example, tracing the capability of the sensor to acquire the defined target, or achieving other simulation objects as required.

The concept of the present invention was described with reference to a specific embodiment, useful for simulation of a target for a specific sensor. It should be understood that the invention is not limited by this embodiment, and is useful for many other applications with required alterations and modifications, without departing from the scope of the invention. Such applications include, but are not limited to, simulation of a specific or generic target; simulation of a target to an unknown sensor; simulation of a target in order to deceive a sensor or a weapon system (fake thermal signature); simulation of a target in order to test or calibrate equipment, and more.

The invention was mainly described with respect to a missile-based simulation system. It should be understood that the invention is not limited by the type of the moving body that caries the active material, and other platforms could be used without departing from the scope of the present invention. Such platforms include other self-propelled bodies or non-self propelled bodies.

The invention was mainly described with respect to simulation of a target during its flight in the endo-atmosphere. It should be understood that the invention is not limited by the flight phase, and the signature of various targets in various phases can be simulated without departing from the scope of the invention. For example, during atmospheric flight, the dynamics of the temperature of the skin of the simulation missile should be considered, in order to produce the desired temperature (IR signature). Any platform/body that develops, by aerodynamic heating, skin temperature which is lower than that required for generating the specific intensity of the target's thermal signature, could be used. Thus, for example, a short-range missile simulates a long-range missile; a relatively simple and cheap missile simulates a sophisticated and expensive missile, and more.

The invention was mainly described with respect to the simulation of a missile. It should be understood that the invention is not limited by the type of the target. Many IR radiating bodies, including stationary as well as moving bodies, could be simulated using the systems and methods of the present invention, with the appropriate modifications and alterations.

As used herein, the phrase "for example," "such as" and variants thereof describing exemplary implementations of the present invention are exemplary in nature and not limiting. Reference in the specification to "one embodiment", "an embodiment", "some embodiments", "another embodiment", "other embodiments" or variations thereof means that a particular feature, structure or characteristic described in connection with the embodiment(s) is included in at least one embodiment of the invention. Thus the appearance of the phrase "one embodiment", "an embodiment", "some embodiments", "another embodiment", "other embodiments" or variations thereof do not necessarily refer to the same embodiment(s). It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

While the invention has been shown and described with respect to particular embodiments, it is not thus limited. In other embodiments of the invention, the system may comprise fewer, more, and/or different modules than those shown in FIGS. 1*a* and 1*b*. In other embodiments of the invention, the system 10 described herein with reference to FIGS. 1*a*-1*b* may include fewer, more and/or different elements and modules than shown in FIGS. 1*a*-1*b*.

While certain features of the invention have been illustrated and described herein, many modifications, substitutions, changes, and equivalents will occur to those skilled in the art. It is therefore to be understood that the appended claims are intended to cover all such modifications and changes as fall within the scope of the claims.

The invention claimed is:

1. An active IR signature target simulation system comprising:

a platform having a known temperature profile and a preplanned flight trajectory;

a heat source carried onboard the platform, capable of producing heat following a controlled heating plan; and a control unit coupled to the heat source and configured for initiation said heat source, thereby modifying said known temperature profile and generating a desired temperature profile required for sensing a simulated target IR signature during a simulation time window at a desired line of sight from the platform to an observing sensor, wherein said platform is an exo-atmospheric missile comprising an inner shell and a perforated outer shell, and said heat source is a thermally active material disposed between at least a part of the inner shell and a part of the perforated outer shell.

2. A system according to claim 1 wherein an isolating layer is disposed on at least a part of an outer face or a part of an inner face of the inner shell.

* * * * *